US007249594B2

(12) United States Patent
Hashiguchi

(10) Patent No.: US 7,249,594 B2
(45) Date of Patent: Jul. 31, 2007

(54) FUEL FEED APPARATUS HAVING INNER CONNECTING STRUCTURE

(75) Inventor: Koichi Hashiguchi, Chiryu (JP)

(73) Assignee: DENSO Corporation (JP)

( * ) Notice: Subject to any disclaimer, the term of this patent is extended or adjusted under 35 U.S.C. 154(b) by 118 days.

(21) Appl. No.: 11/047,728

(22) Filed: Feb. 2, 2005

(65) Prior Publication Data

US 2005/0166974 A1 Aug. 4, 2005

(30) Foreign Application Priority Data

Feb. 3, 2004 (JP) ..... 2004-027131

(51) Int. Cl.
*F02M 37/04* (2006.01)

(52) U.S. Cl. ..... 123/509

(58) Field of Classification Search ..... 123/509, 123/497; 137/574
See application file for complete search history.

(56) References Cited

U.S. PATENT DOCUMENTS

| | | | | |
|---|---|---|---|---|
| 4,869,225 | A * | 9/1989 | Nagata et al. | 123/509 |
| 4,945,884 | A | 8/1990 | Coha et al. | |
| 5,107,889 | A * | 4/1992 | Sasaki et al. | 137/574 |
| 5,762,049 | A * | 6/1998 | Jones et al. | 123/514 |
| 5,787,865 | A * | 8/1998 | Harris et al. | 123/516 |
| 6,520,161 | B2 | 2/2003 | Hazama | |
| 6,752,129 | B2 | 6/2004 | Isozaki et al. | |
| 6,886,541 | B2 * | 5/2005 | Powell | 123/509 |
| 2001/0047827 | A1 * | 12/2001 | Murakoshi et al. | 137/565.34 |
| 2003/0102033 | A1 | 6/2003 | DaSilva et al. | |

FOREIGN PATENT DOCUMENTS

JP 2001-280209 10/2001

OTHER PUBLICATIONS

Chinese Office Action issued Dec. 29, 2006 in counterpart Chinese Application No. 2005-10006279.5 with English translation.

* cited by examiner

*Primary Examiner*—Thomas Moulis
(74) *Attorney, Agent, or Firm*—Nixon & Vanderhye PC

(57) ABSTRACT

A fuel feed apparatus feeds fuel in a fuel tank to the outside of the fuel tank. The fuel feed apparatus includes a flange that covers an accommodation hole of the fuel tank, a fuel pump that pumps fuel, and a sub-tank accommodating the fuel pump. The sub-tank is capable of reciprocating relative to the flange in the axial direction of struts, which support the flange. The struts are positioned circumferentially outwardly to the sub-tank. The sub-tank has a lid 70. Holding portions are provided on the lid to axially movably hold the struts. Thus, an assembling work of the fuel feed apparatus can be eased without damaging internal components, when the struts are assembled.

21 Claims, 4 Drawing Sheets

FUEL FEED APPARATUS HAVING INNER CONNECTING STRUCTURE

CROSS REFERENCE TO RELATED APPLICATIONS

This application is based on and incorporates herein by reference Japanese Patent Application No. 2004-27131 filed on Feb. 3, 2004.

FIELD OF THE INVENTION

This invention relates to a fuel feed apparatus, and is preferably applied to a fuel feed apparatus that feeds fuel in a fuel tank to the outside of the fuel tank, for example.

BACKGROUND OF THE INVENTION

Conventionally, fuel feed apparatuses stably feed fuel even when a residual quantity of fuel in a fuel tank is reduced. In some fuel feed apparatuses of this type, a bottom of a sub-tank of a fuel feed apparatus is constantly urged against the inner bottom wall of the fuel feed apparatus.

For example, U.S. Pat. No. 4,945,884 discloses an arrangement, in which struts capable of expansion and contraction are mounted to a flange that covers an opening (100*a*) of a fuel tank. The struts are held by a lid of a sub-tank, so that the struts stroke inside the inner periphery of the sub-tank. The bottom of the sub-tank is urged against the inner bottom wall of the fuel tank by resilient force of the struts.

However, in the conventional construction in U.S. Pat. No. 4,945,884, the physical relationship among the struts and internal components in the sub-tank cannot be confirmed through the sidewall of the sub-tank, when the struts are assembled to the sub-tank. Therefore, confirmation of presence and absence of interference among the struts and components received in the sub-tank may be difficult.

Besides, a corner of a bottom portion of the sub-tank may be formed in an arcuate-shape for smoothing an installation work, in which the sub-tank is inserted into a fuel tank.

The struts may strike against the arcuate-shaped inner surface of the sub-tank, when the struts stroke within the inner periphery of the sub-tank disclosed in U.S. Pat. No. 4,945,884. Accordingly, a degree of the stroke, by which the struts expand and contract, may decrease.

SUMMARY OF THE INVENTION

In view of the foregoing problems, it is an object of the present invention to produce a fuel feed apparatus that has a structure, in which a component such as a strut, which is capable of extending and contracting relative to the sub-tank, is efficiently assembled to the sub-tank without damaging internal components received in a sub-tank.

It is another object to produce a fuel feed apparatus that has a structure, in which the strut or the like is efficiently assembled to the sub-tank without damaging the internal components, and a degree of the stroke of the struts is capable of being maintained.

According to the present invention, a fuel feed apparatus, which feeds fuel in a fuel tank to the outside of the fuel tank, includes a flange, a fuel pump, a strut, and a sub-tank. The flange covers an opening of the fuel tank. The fuel pump pumps fuel. The strut supports the flange. The sub-tank is capable of accommodating the fuel pump. The sub-tank has a lid that is movably connected with the strut, such that the sub-tank and the lid are capable of reciprocating relative to the flange in a substantially axial direction of the strut.

The strut is positioned on a circumferentially outwardly lateral side of the sub-tank. The lid has a holding portion that movably holds the strut in a substantially axial direction of the strut. The strut is positioned in the outside of the inner space of the sub-tank with respect to a sidewall of the sub-tank. The holding portion projects from the lid in the substantially axial direction of the strut. The holding portion is located in a groove formed in an outer periphery of the sub-tank. The holding portion is capable of being inserted into the groove in the substantially axial direction of the strut.

A method for assembling a fuel feed apparatus includes flowing steps. A strut is secured to a flange. A resilient member is inserted coaxially outward to the strut. The strut is inserted into a holding portion formed in a lid. here, the holding portion projects from the lid to the opposite side of the flange. A tube is connected between the flange and a fuel pump received in a sub-tank through the lid. The holding portion of the lid is positioned on a circumferentially outward of the sub-tank.

Presence and absence of interference, which is caused among the tube, the shafts and the springs, is visually confirmed when the holding portion is positioned on the circumferentially outward of the sub-tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
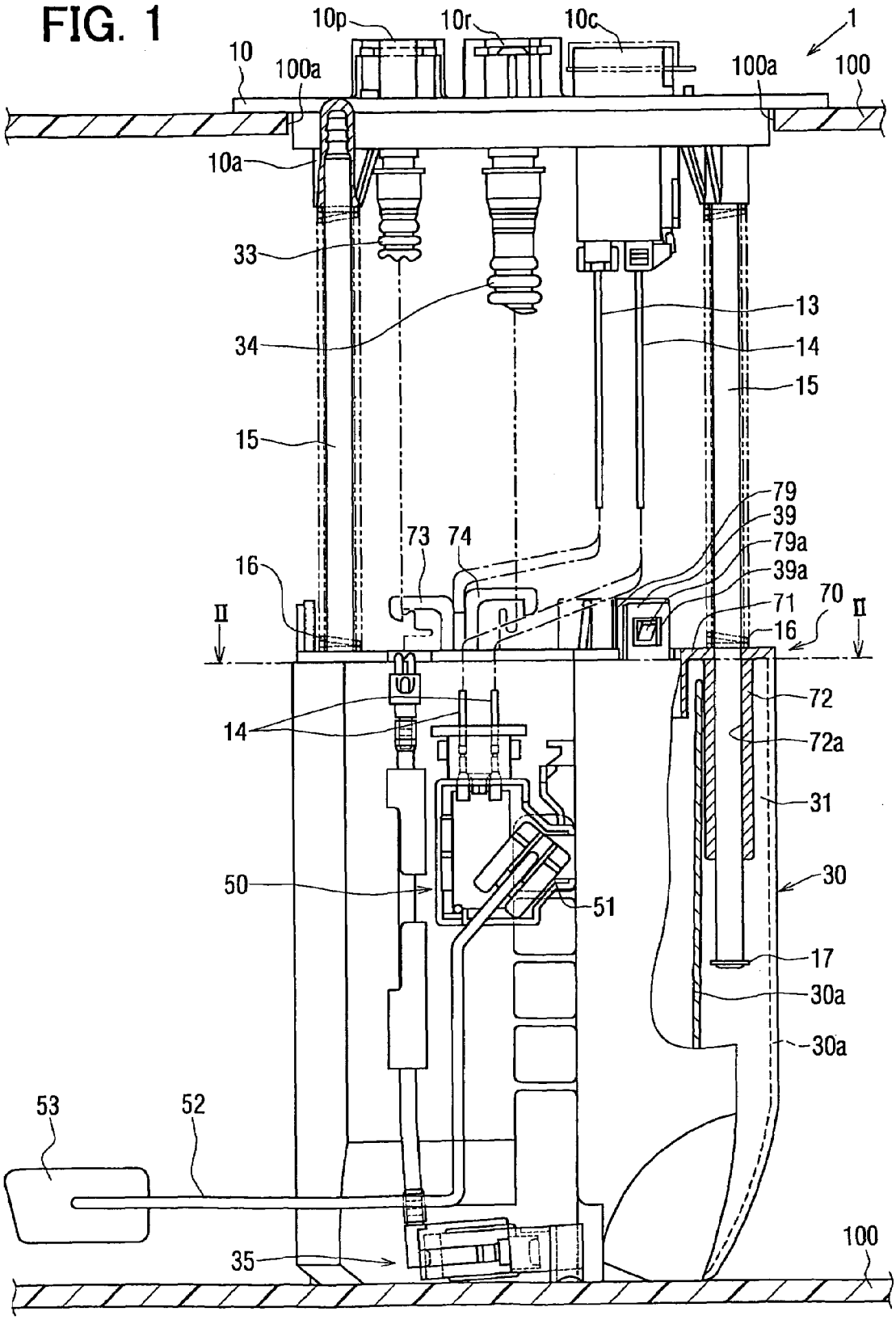
FIG. 1 is a partially cross sectional side view showing a fuel feed apparatus according to a first embodiment of the present invention.
Figure 2:
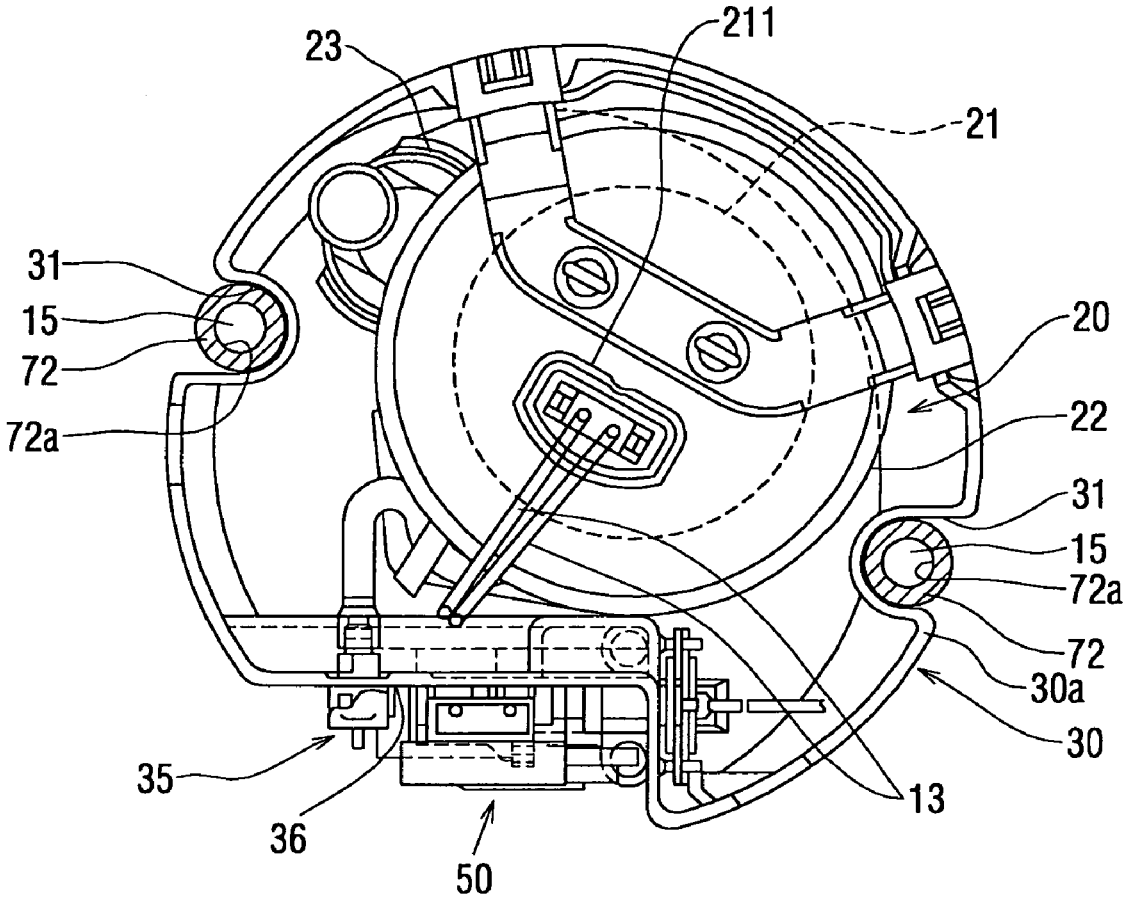
FIG. 2 is a partially cross sectional top view taken along the line II-II in FIG. 1 according to the first embodiment.

As shown in FIGS. 1, 2, a fuel feed apparatus 1 includes a flange 10, a fuel pump 21 (FIG. 2), a sub-tank 30, and shafts (struts) 15. The flange 10 is formed to be substantially disk-shaped, and mounted to the upper wall of a fuel tank 100 in a manner to cover an accommodation hole (opening) 100*a* of the fuel tank 100. Other members such as the fuel pump 21, the sub-tank 30 are accommodated in the fuel tank 100. The fuel tank 100 may be integrally formed of either resin or metal. In the embodiment, the fuel tank 100 and the flange 10 are formed of resin.

The flange 10 and the sub-tank 30 are movable relative to each other via the shafts 15 and a lid 70 therebetween. One of the flange 10 and the sub-tank 30 is assembled in a manner to guide the other of the flange 10 and the sub-tank 30 in the axial direction of the shafts 15. The flange 10 and the sub-tank 30 are biased in directions away from each other by resilient members 16 via the lid 70 therebetween. The resilient members 16 serve as biasing means. The resilient members 16 are guided by the shafts 15. Thereby, the bottom of the sub-tank 30 is urged against the inner bottom wall of the fuel tank 100 in a state, in which the fuel feed apparatus 1 is installed in a fuel tank 100.

The accommodation hole 100*a* is formed in the fuel tank 100 such that other components of the fuel feed apparatus 1 such as the sub-tank 30 are to be inserted therethrough. The accommodation hole 100*a* is larger than the sub-tank 30 in outside diameter, and is smaller than the flange 10 in outside diameter.

As shown in FIG. 1, a fuel discharge pipe 10*p*, a fuel return pipe 10*r*, and a connector 10*c* are mounted to the flange 10. The fuel discharge pipe 10*p*, the fuel return pipe 10*r*, and the connector 10*c* may be formed integral with the flange 10. The fuel discharge pipe 10*p* serves as a pipe, through which fuel discharged from the fuel pump 21 of a pump module 20 shown in FIG. 2 is fed to the outside the fuel tank 100. The fuel return pipe 10*r* serves as a pipe, through which surplus fuel from an engine is returned into the fuel tank 100. The fuel return pipe 10*r* is connected to a jet pump 35 through a bellows tube (bellows pipe, FIG. 1) 34. The connector 10*c* includes an electrically connectable lead wires (wiring member) 13, 14. The lead wire 13 extends from the connector 10*c*, and connects to the fuel pump 21. The lead wire 14 extends from the connector 10*c*, and connects to a sender gage (level gage) 50. The connector 10*c* supplies the fuel pump 21 with drive current, and outputs a detection signal of the sender gage 50.

The pump module 20, a suction filer (not shown), and the like are accommodated within the sub-tank 30. As shown in FIG. 2, the pump module 20 includes a fuel filter 22, the fuel pump 21, and a pressure regulator 23. The fuel filter 22 includes a filter case, which is constructed of a case body (not shown) and a cover, and a filter element. The fuel filter 22 circumferentially covers the outside of the fuel pump 21. The case body and the cover are fixed by means of welding or the like. An inlet port of the case body is fitted onto a discharge port of the fuel pump 21. The filter element removes foreign matters contained in fuel discharged from the fuel pump 21.

The fuel pump 21 is accommodated vertically in the sub-tank 30 such that a fuel discharge side of the fuel pump 21 is positioned upwardly in the gravitational direction and a fuel inlet side of the fuel pump 21 is positioned downwardly in the gravitational direction. The fuel pump 21 includes a connector portion 211 that is connected to the connector 10*c* via the lead wires 13. The connector is exposed from the cover of the filter case of the fuel filter 22. The fuel pump 21 accommodates a motor (not shown), and generates suction force using a rotating member such as an impeller, which is rotated by the motor. The pressure regulator 23 has an inlet port that is connected to an outlet port (not shown) of the case body of the filter case of the fuel filter 22. The pressure regulator 23 regulates pressure of fuel, which is discharged from the fuel pump 21. The filter element removes foreign matters from the fuel. As referred to FIG. 1, the fuel, which is regulated in pressure, flows to the fuel discharge pipe 10*p* through the bellows tube 33.

The suction filter is connected to an inlet port of the fuel pump 21. The suction filter contacts with the inner wall of the bottom of the sub-tank 30. The outer periphery of the suction filter is covered with a piece of nonwoven fabric to remove relatively large foreign matters contained in fuel drawn from the sub-tank 30 by the fuel pump 21.

As shown in FIGS. 1, 2, the jet pump 35, which supplies fuel in the fuel tank 100 into the sub-tank 30, is mounted outside of the sub-tank 30. The jet pump 35 is supplied with high-pressure fuel, which is taken out of a midway in a pressure rising portion of the fuel pump 21, to jet the high-pressure fuel into an inlet port (not shown) of the sub-tank 30 from a nozzle (not shown). In addition, surplus fuel discharged from the pressure regulator 23, or surplus fuel returned from the side of the engine may be supplied and jetted toward the inlet port from the nozzle. The jet pump 35 supplies fuel within the fuel tank 100 into the sub-tank 30 using suction pressure, which is generated by jetting the fuel. Thereby, the sub-tank 30 is filled with fuel, even when a fuel quantity within the fuel tank 100 is decreased.

The sub-tank 30 is formed in a substantially cylindrical shape with a bottom. As shown in FIG. 2, the sub-tank 30 includes a stepped portion 36, in which a sidewall 30*a* is partially circumferentially depressed to extend radially inward. The sub-tank 30 is formed to be substantially cylindrical-shaped excluding the stepped portion 36. In contrast, the stepped portion 36 is formed to be substantially flat. As shown in FIGS. 1, 2, the jet pump 35 and the sender gage 50 (specifically, a sensor 51) are arranged in the stepped portion 36. By forming the flat stepped portion 36 on the sub-tank 30, the sub-tank 30 is decreased in projected area with respect to the top face of the fuel tank 100, so that an area occupied and required for installation of the sub-tank 30 is decreased. An internal space, in which the pump module 20, the pressure regulator 23, and the suction filter are accommodated, is formed inside the sidewall 30*a* of the sub-tank 30.

The outer periphery of the sidewall 30*a* of the sub-tank 30, which defines the internal space, has grooves 31 in a substantially U-shaped cross section. Guide portions (holding portions) 72 downwardly project from the lid 70 in the substantially axial direction of the shafts 15, so that the holding portions 72 are axially insertable into the grooves 31. The holding portions 72 may axially engage with the grooves 31.

The shafts 15 have one ends thereof, which are press-fitted into the flange 10, and the other ends thereof, which are loosely inserted into the guide portions 72, which are formed on the lid 70. Specifically, the other ends of the shafts 15 are inserted through the guide portions 72, and restriction members 17 such as circlips 17 are provided on the other ends of the shafts 15 axially inserted through the guide portions 72. The restriction members 17 restrict movements of the flange 10 and the lid 70 in directions, in which the flange 10 and the lid 70 separate from each other. The resilient members 16 are respectively arranged on the shafts 15, so that the resilient members 16 are guided by the shafts 15. The resilient members (compression springs) 16, which are constituted by biasing means such as compression spring, are inserted between the upper surface of the lid 70 and seats 10*a* formed in the flange 10.

Figure 4:
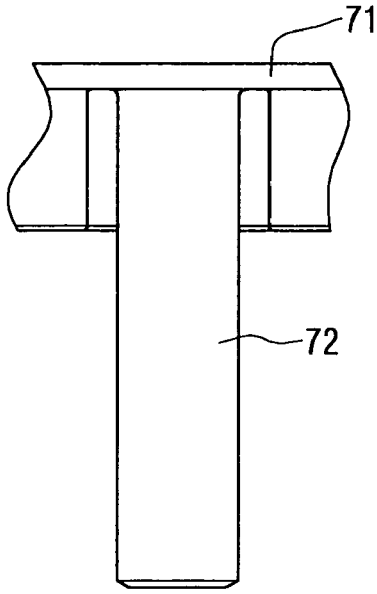
FIG. 4 is a side view when being viewed from the arrow IV in FIG. 3 according to the first embodiment.

As referred to FIG. 1, the lid 70 includes an upper lid portion 71 assembled to the upper end of the sub-tank 30, and the guide portions 72 downwardly projecting from the upper lid portion 71 in a direction, in which the shafts 15 are axially moved. The guide portions 72 have guide holes that support the shafts 15 such that the shafts 15 are capable of axially reciprocating. The guide portions 72 project axially downward from the radially outer periphery of the upper lid portion 71. Specifically, the guide portions 72 are formed in a substantially cylindrical-shape, and projected in the direction, in which the lid 70 is assembled to the sub-tank 30 (FIGS. 1, 4). The upper lid portion 71 is formed in a substantially plate-shape. The upper lid portion 71 includes an engagement structure 79, 39 that are to be assembled and fixed to the sub-tank 30. As shown in FIG. 1, engaging portions 79 are provided on the upper lid portion 71. Each engaging portion 79 has a claw 79*a*. Engaged portions 39 are provided on the sub-tank 30. Each engaged portion 39 has a hole 39*a* that is capable of engagement with the claw 79*a*. Engaging portions having a claw may be provided on the sub-tank 30, and engaged portions having a hole capable of engagement with the claw may be provided on the upper lid portion 71.

Figure 3:
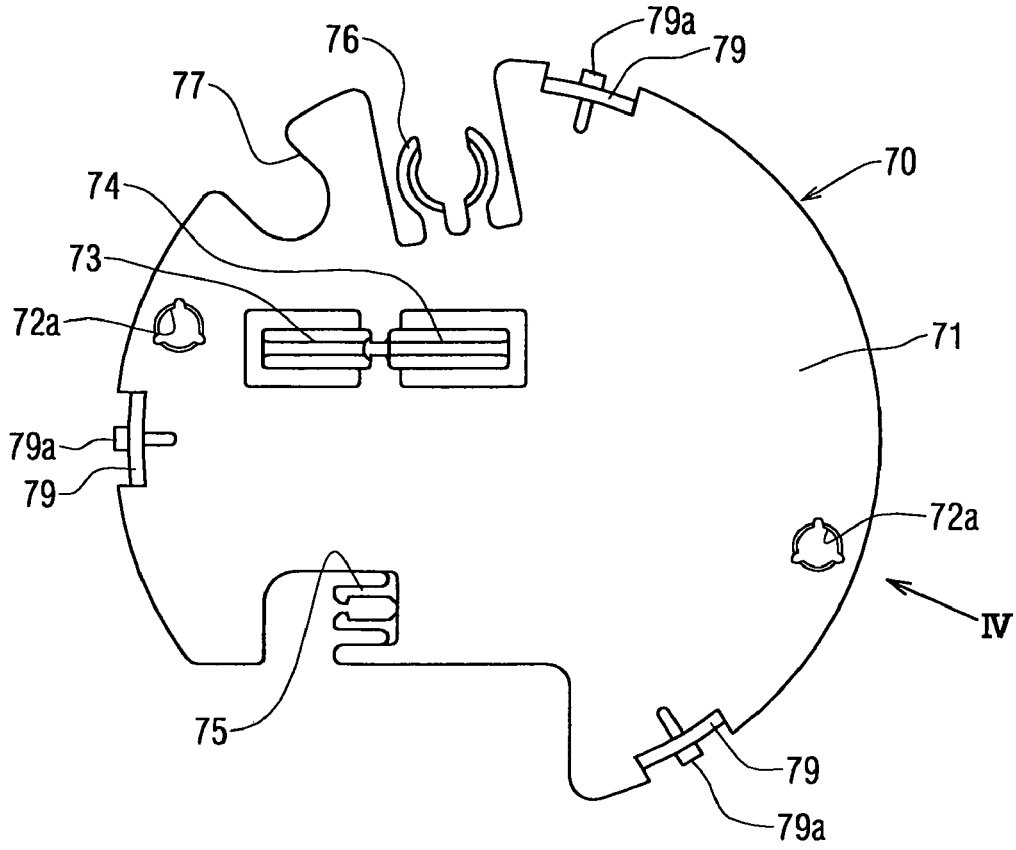
FIG. 3 is a top view showing a lid of the fuel feed apparatus according to the first embodiment.

The upper lid portion 71 preferably defines a guide opening, which guides an internal flexible component such as the lead wire 13. The upper lid portion 71 preferably includes latches 73, 74, 76, which clamp internal components, as shown in FIG. 3. Specifically, the bellows tube 33, which connects the pressure regulator 23 and the fuel discharge pipe 10*p*, is guided to the guide opening 77. The bellows tube 34 passes through the fuel return pipe 10*r*, and the bellows tube 34 is clamped to the latch 76. Surplus fuel is returned from the engine side, and the surplus fuel flows through the bellows tube 34. The lead wire 13, which connects the connector portion 211 on the fuel pump 21 to the connector 10*c*, is clamped. The latches 73, 74 are provided to the upper lid portion 71 to project therefrom in a substantially L-shaped manner. The latch 73 has an intermediate clamping function of clamping the bellows tube 33 guided to the guide opening 77. The latch 74 has an intermediate clamping function of clamping the bellows tube 34 clamped to the latch 76.

As referred to FIG. 1, the sender gage 50 includes the sensor 51, an arm member 52, and a float 53. The float 53 is mounted to a tip end of the arm member 52, and the float 53 floats in fuel in the fuel tank 100. The arm member 52 turns around its end on the side of the sensor 51. The sensor 51 is formed with multiple conductive patterns having different resistance. The end of the arm member 52, which is opposite to the float 53, is capable of electrically contacting with the conductive patterns of the sensor 51. The float 53, which floats in the fuel in the fuel tank 100, moves in accordance with a residual quantity of fuel in the fuel tank 100, so that the arm member 52 turns as the float 53 moves. As a result, a state of contact between the arm member 52 and the conductive patterns of the sensor 51 varies, and a residual quantity of the fuel in the fuel tank 100 is detected. The residual quantity of fuel in the fuel tank 100 is detected, and output as an electronic signal to the ECU via the lead wire 14 and the connector 10*c*. The ECU serves as a control means (not shown).

In addition, the sensor 51, the arm member 52, and the float 53 constitute a projecting portion that projects substantially radially from the sub-tank 30. As shown in FIG. 1 an external form of a portion of the sub-tank 30, which is located on a side substantially radially opposite to the projecting portion, is arcuate to smooth insertion when the sub-tank 30 is inserted from the accommodation hole 100*a* formed in the fuel tank 100.

Next, a manufacturing method is described with reference to FIG. 1. The lead wires 13, 14 extend in a direction indicated by alternate long and short dash lines in FIG. 1. The bellows tubes 33, 34 extend in a direction indicated by alternate long and two short dashes lines.

Main assembling process of the manufacturing method includes a first process and a second process. The flange 10, the shafts 15, the lid 70, and the like are assembled in the first process. The assembled unit, which is assembled in the first process, is assembled to the sub-tank 30 in the second process. Specifically in the first process, the flange 10 and the lid 70 are assembled together via the shafts 15 and the compression springs 16 therebetween to form the assembled unit. The shafts 15 are press-fitted into the seats 10*a* of the flange 10 to be fixed thereto. After the shafts 15 are inserted into the compression springs 16 on one ends, the other ends of the shafts 15 are inserted through guide holes 72*a* of the guide portions 72 formed on the lid 70. The circlips 17 are fixed onto the other ends of the shafts 15. As a result, the assembled unit, which is constructed of the flange 10, the lid 70, the shafts 15, the compression springs 16, and the like, is formed. The assembled unit is assembled such that one of the flange 10 and the lid 70 axially guides and restricts the other of the flange 10 and the lid 70 in movements in the separating directions, in which the flange 10 and the lid 70 are separated from each other. In addition, the compression springs 16 are put in a compressed state to bias the flange 10 and the lid 70 in directions away from each other in the assembled unit. Besides, the assembled unit may be put in a state, in which any biasing force is not generated and the compression springs 16 are only guided by the shafts 15, as long as a degree of the stroke of the shafts 15 between the flange 10 and the lid 70 is not decreased by external force.

In the second process, the assembled unit is assembled to the sub-tank 30. The internal components such as the fuel pump 21 are beforehand constructed in a separate process, and assembled to the pump module 20. Subsequently, the pump module 20 is assembled to the sub-tank 30. Besides, in the second process, the fuel pump 21 and the like may be assembled together to construct the pump module 20 and assembled to the sub-tank 30, before the assembled unit is assembled to the sub-tank 30. In the second process, the bellows tube 33 and the lead wire 13 are respectively connected to the pressure regulator 23 and the connector portion 211 of the pump module 20 that are assembled to the sub-tank 30. Subsequently, the guide portions 72 of the assembled unit, i.e., the lid 70 are arranged in positions of the grooves 31 of the sub-tank 30 to be inserted along the grooves 31 downward in the axial direction of the guide portions 72. At this time, the guide portions 72 project in the direction of assembly, in which the assembled unit is joined to the sub-tank 30. Therefore, assembly can be performed, while presence and absence of interference among the bellows tube 33, the lead wire 13 and the guide portions 72 are confirmed. Besides, the shafts 15 are positioned on the lateral side of the sub-tank 30. Specifically, the shafts 15 are positioned on the circumferentially outwardly lateral side of the sub-tank 30.

Specifically, the shafts 15 are positioned outside the sidewall 30*a* of the sub-tank 30, so that assembly can be performed while presence and absence of interference, which is caused among the internal components such as the bellows tubes 33, 34, the shafts 15 and the springs 16, is visually confirmed.

When such insertion is continued, the claws 79*a* on the lid 70 and the holes 39*a* of the sub-tank 30 engage with each other to be able to form a snap-fit engagement. The lid 70 is fixed to the upper end of the sub-tank 30 by the snap-fit engagement. At this time, the bellows tube 33 and the lead wire 13 are respectively inserted along the guide opening 77 and the latch 76 on the lid 70. Subsequently, the sender gage 50 and the jet pump 35, which constitute members outside the sub-tank 30, are assembled and fixed to the stepped portion 36 of the sub-tank 30. The lead wires 13, 14 are connected to the connector 10*c*. The bellows tube 33 is clamped to the latch 73 shown in FIGS. 1, 3, and is connected to the fuel discharge pipe 10*p* on the flange 10. Likewise, the bellows tube 34 is clamped to the latches 76, 74 on the lid 70, and connected to the fuel return pipe 10*r*.

In assembling the fuel feed apparatus 1 into the fuel tank 100, a degree of the stroke of the shafts 15 between the flange 10 and the sub-tank 30 (specifically, the lid 70) is decreased, so that the bottom of the sub-tank 30 is pushed against the inner bottom wall of the fuel tank 100. At this time, the shafts 15 are positioned on the circumferentially outwardly lateral side of the sub-tank 30, so that assembly can be performed while presence and absence of interference, which is caused among the internal components such as the bellows tubes 33, 34, the shafts 15 and the springs 16, is visually confirmed.

Subsequently, an operation of the fuel feed apparatus 1 is described. When an engine is driven and a drive current is fed to the pump body of the fuel pump 21 through the connector 10*c*, the fuel pump 21 draws fuel in the sub-tank 30 while removing foreign matters, and thereafter discharges the fuel to the side of the engine through the discharge pipe 10*p*. Fuel, which returns from the side of the engine through the fuel return pipe 10*r*, passes through the jet pump 35 to be jetted toward the inlet port of the sub-tank 30, so that suction pressure is generated to draw fuel in the fuel tank 100. A liquid level in the sub-tank 30 is caused by the suction pressure of the jet pump 35 to rise relative to the outside of the sub-tank 30, and maintained at a predetermined level. The sub-tank 30 is pushed against the inner bottom wall of the fuel tank 100, so that the fuel pump 21 draws fuel in the sub-tank 30 without causing failure in drawing of fuel, and continuously feeds the fuel to the engine, even when the vehicle turns or travels on a steep slant surface in a state, in which a liquid level in the fuel tank 100 is lowered.

The function and effect of the embodiment is described.

The fuel feed apparatus 1, which feeds fuel in the fuel tank 100 to the outside of the fuel tank 100, includes the flange 10 that covers the accommodation hole 100*a* of the fuel tank 100, and the sub-tank 30 capable of reciprocating relative to the flange 10 in the axial direction of the shafts 15 that supports the flange 10. The shafts 15 are positioned on the lateral side of the sub-tank 30. The lid 70 is provided on the sub-tank 30. The guide portions 72, which hold the shafts 15 movably in the axial direction of the shafts 15, are provided to the lid 70 to axially project therefrom. The shafts 15 are positioned on the lateral side of the sub-tank 30. Thereby, assembly can be carried out in the assembling work while visual confirmation is performed.

Presence and absence of interference, which is caused among the internal components such as the bellows tubes 33, 34 and the shafts 15, is capable of being visually confirmed, so that the internal components may not be damaged. As a result, an assembling quality can be improved because assembly can be carried out while visual confirmation is performed.

Additionally, as a way to arrange the shafts 15 on the circumferentially outwardly lateral side of the sub-tank 30, it is preferable to position the guide portions 72 in the grooves 31 formed on the outer periphery of the sub-tank 30. In this structure, the shafts 15 are positioned outward with respect to the inner space of the sub-tank 30. The shafts 15 are capable of being arranged on the outer circumferentially outwardly lateral side of the sub-tank 30, so that an inner peripheral surface of the sub-tank 30 is protected from being struck and damaged by the shafts 15 when a degree of the stroke of the shafts 15 is increased and decreased. Accordingly, a degree of the stroke of the shafts, which extends and contracts with respect to the sub-tank 30, can be increased without being restricted by the inner peripheral surface of the sidewall 30*a* of the sub-tank 30, even when the sidewall 30*a* of the sub-tank 30 is formed to be arcuate in shape for easing the insertion work of the sub-tank 30 into the fuel tank 100.

Additionally, when the assembling work is performed in the first process, the flange 10 and the lid 70 are first assembled together via the shafts 15 and the compression springs 16, which are guided by the shafts 15, to form the assembled unit 10, 70, 15, 16. In the second process, the assembled unit 10, 70, 15, 16, which is assembled in the first process, is joined to the sub-tank. Therefore, the assembled unit and the sub-tank 30 can be easily assembled together, even when the assembled unit is assembled in such a manner that the compression springs 16, which are arranged between the flange 10 and the lid 70, are put in a compressed state. Specifically, the assembled unit and the sub-tank 30 can be easily assembled together, regardless of the compression state of the compression springs 16. In this structure, the compression springs 16 is restricted by the shafts 15, the lid 70 and the flange 10 using the circlips 17, so that the condition of the assembled unit 10, 70, 15, 16, in which resilient force of the compression springs 16 is applied between the lid 70 and the flange 10, becomes stable.

In this structure, the assembled unit 10, 70, 15, 16 is assembled such that one of the flange 10 and the lid 70 axially guides and restricts the other of the flange 10 and the lid 70 in movements in the separating direction.

Additionally, the guide portions 72 project from the lid 70 in the assembling direction, so that a state, in which the guide portions 72 and the sub-tank 30 are assembled, can be visually confirmed in assembling the lid 70 to the sub-tank 30, i.e., assembling the guide portions 72 to the sub-tank 30. Accordingly, the shafts 15, which expand and contract in stroke with respect to the sub-tank 30, are capable of being visually confirmed, and assembly of the holding portions 72, which hold the shafts 15, and the sub-tank 30 are capable of being visually confirmed, so that an assembling quality can be improved.

For example, in assembling the flange 10 and the lid 70 via the shafts 15 and the like, the assembled unit can be easily constructed, while presence and absence of interference, which is caused among the shafts 15 and the internal components, is visually confirmed in this structure. Further, the assembled unit 10, 70, 15, 16 and the sub-tank 30 can be easily assembled together, while the holding portions 72, which project from the assembled unit, and the sub-tank 30 is visually confirmed.

Additionally, as a way to join the lid 70 and the sub-tank 30 together, the lid 70 and the sub-tank 30 are preferably applied to a fuel feed apparatus having a construction of a snap-fit engagement. In the snap-fit engagement, one of the lid 70 and the sub-tank 30 includes engaging portions 79 having a claw 79*a*, and the other of the lid 70 and the sub-tank 30 includes engaged portions 39 having a hole 39*a* capable of engagement with the claw 79*a*. Thereby, the assembling work of fixing the lid 70 and the sub-tank 30 together is made easy.

Second Embodiment

Figure 5:
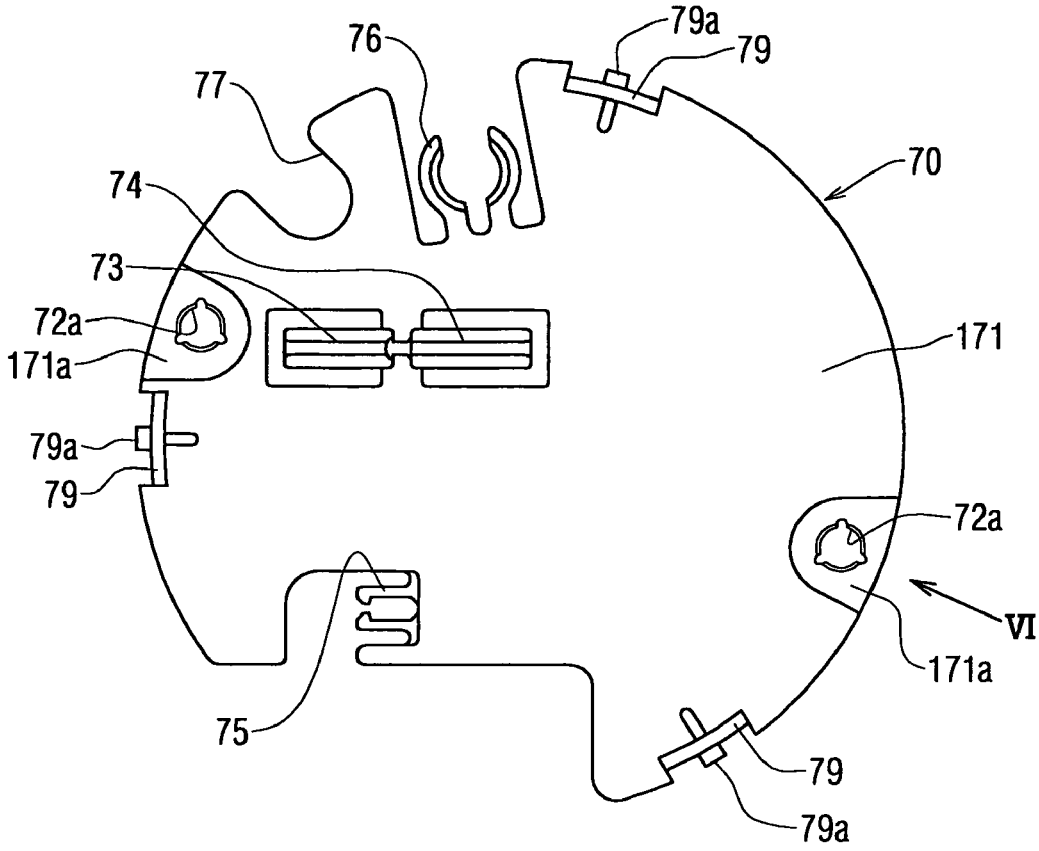
FIG. 5 is a top view showing a lid of the fuel feed apparatus according to a second embodiment of the present invention.
Figure 6:
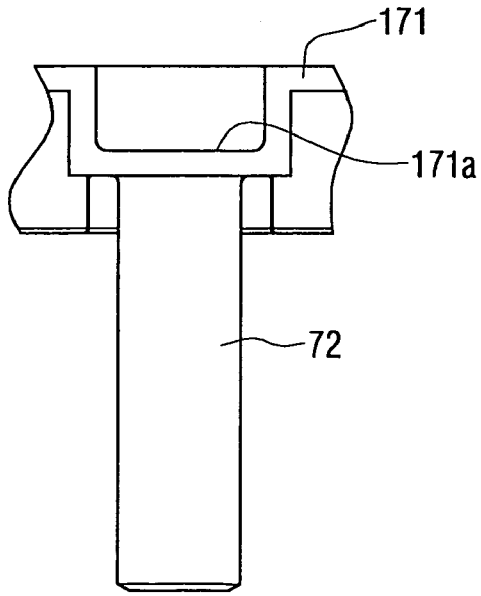
FIG. 6 is a side view when being viewed from the arrow VI in FIG. 5 according to the second embodiment.

In this embodiment, an upper lid portion 171 having a stepped portion 171*a* shown in FIGS. 5, 6 is provided, instead of the upper lid portion 71 in the form of the substantially flat plate. As shown in FIG. 6, the guide portion 72 projects from the stepped portion 171*a* in the assembly direction.

With such construction, the same effect as that in the above embodiment can be produced. Besides, each compression spring 16 can be partially received in the stepped portion 171*a* of the upper lid portion 171, so that the compression spring 16 can be radially restricted within the stepped portion 171*a*. Additionally, each shaft 15 can be positioned within the stepped portion 171*a*, and the shaft 15 can be inserted into the guide portion 72. Thereby, the compression spring 16, the shafts 15, and the upper lid portion 171 can be easily assembled to each other.

Further, a spacing between the flange 10 and the lid 70 can be increased for a degree corresponding to the stepped portion 171*a*, so that compression springs 16, which bias the flange 10 and the lid 70 in directions away from each other, can be increased in freedom of design.

Various modifications and alternations may be diversely made to the above embodiments without departing from the spirit of the present invention.

What is claimed is:

1. A fuel feed apparatus that feeds fuel in a fuel tank to an outside of the fuel tank, the fuel feed apparatus comprising:

a flange that covers an opening of the fuel tank;

a fuel pump that pumps fuel;

a strut that supports the flange; and a sub-tank that is capable of accommodating the fuel pump, the sub-tank having a lid that is movably connected with the strut such that the sub-tank and the lid are capable of reciprocating relative to the flange in a substantially axial direction of the strut, wherein the strut is positioned radially outward with respect to the sub-tank, and the lid has a holding portion that holds the strut movably in a substantially axial direction of the strut, and wherein the holding portion is capable of being inserted into a groove formed in an outer periphery of the sub-tank in the substantially axial direction of the strut.

2. The fuel feed apparatus according to claim 1, wherein the strut is positioned in an outside of an inner space defined within the sub-tank with respect to a sidewall of the sub-tank.

3. The fuel feed apparatus according to claim 1, wherein the holding portion projects from the lid in the substantially axial direction of the strut.

4. The fuel feed apparatus according to claim 1, wherein the holding portion is capable of engaging with the groove in the substantially axial direction of the strut.

5. The fuel feed apparatus according to claim 1, wherein the holding portion projects from the lid in a direction, in which the lid is assembled to the sub-tank.

6. A fuel feed apparatus that feeds fuel in a fuel tank to an outside of the fuel tank, the fuel feed apparatus comprising:

a flange that covers an opening of the fuel tank;

a fuel pump that pumps fuel;

a strut that supports the flange; and a sub-tank that is capable of accommodating the fuel pump, the sub-tank having a lid that is movably connected with the strut such that the sub-tank and the lid are capable of reciprocating relative to the flange in a substantially axial direction of the strut, wherein the strut is positioned circumferentially outward with respect to the sub-tank, and the lid has a holding portion that holds the strut movably in a substantially axial direction of the strut, wherein the lid and the sub-tank have a snap-fit engagement structure, and wherein one of the lid and the sub-tank includes an engaging portion having a claw, the other of the lid and the sub-tank includes an engaged portion having a hole capable of engaging with the claw, and the lid and the sub-tank are joined together by engagement of the claw and the hole.

7. The fuel feed apparatus according to claim 1, wherein the sub-tank includes a bottom portion that has a substantially arcuate-shape.

8. The fuel feed apparatus according to claim 1, further comprising:

a restriction member that is provided to an end portion of the strut, wherein the restriction member is located on an opposite side of the flange with respect to the lid, wherein the restriction member restricts movements of the flange and the lid in a direction in which the flange and the lid are spaced from each other.

9. A fuel feed apparatus that feeds fuel in a fuel tank to an outside of the fuel tank, the fuel feed apparatus comprising:

a flange that covers an opening of the fuel tank;

a fuel pump that pumps fuel;

a strut that supports the flange; and a sub-tank that is capable of accommodating the fuel pump, the sub-tank having a lid that is movably connected with the strut such that the sub-tank and the lid are capable of reciprocating relative to the flange in a substantially axial direction of the strut, wherein the strut is positioned circumferentially outward with respect to the sub-tank, and the lid has a holding portion that holds the strut movably in a substantially axial direction of the strut, and further comprising:

a resilient member that is arranged between the flange and the lid, wherein the resilient member is guided by the strut, the flange and the lid are assembled together via the strut and the resilient member to form an assembled unit, and the assembled unit is assembled to the sub-tank, and wherein the lid defines a stepped portion that is recessed from a surface of the lid to the side of the sub-tank in the substantially axial direction of the strut, the stepped portion is arranged substantially coaxially with respect to the holding portion, the strut is inserted into the holding portion, the resilient member is arranged circumferentially outwardly with respect to the strut, and the stepped portion at least partially receives the resilient member.

10. The fuel feed apparatus according to claim 6, wherein the strut is positioned in an outside of an inner space defined within the sub-tank with respect to a sidewall of the sub-tank.

11. The fuel feed apparatus according to claim 6, wherein the holding portion projects from the lid in the substantially axial direction of the strut.

12. The fuel feed apparatus according to claim 6, wherein the holding portion is located in a groove formed in an outer periphery of the sub-tank.

13. The fuel feed apparatus according to claim 6, wherein the holding portion projects from the lid in a direction, in which the lid is assembled to the sub-tank.

14. The fuel feed apparatus according to claim 6, wherein the sub-tank includes a bottom portion that has a substantially arcuate-shape.

15. The fuel feed apparatus according to claim 6, further comprising: a restriction member that is provided to an end portion of the strut, wherein the restriction member is located on an opposite side of the flange with respect to the lid, wherein the restriction member restricts movements of the flange and the lid in a direction in which the flange and the lid are spaced from each other.

16. The fuel feed apparatus according to claim 9, wherein the strut is positioned in an outside of an inner space defined within the sub-tank with respect to a sidewall of the sub-tank.

17. The fuel feed apparatus according to claim 6, wherein the holding portion projects from the lid in the substantially axial direction of the strut.

18. The fuel feed apparatus according to claim 9, wherein the holding portion is located in a groove formed in an outer periphery of the sub-tank.

19. The fuel feed apparatus according to claim 9, wherein the holding portion projects from the lid in a direction, in which the lid is assembled to the sub-tank.

20. The fuel feed apparatus according to claim 9, wherein the sub-tank includes a bottom portion that has a substantially arcuate-shape.

21. The fuel feed apparatus according to claim 9, further comprising: a restriction member that is provided to an end portion of the strut, wherein the restriction member is located on an opposite side of the flange with respect to the lid, wherein the restriction member restricts movements of the flange and the lid in a direction in which the flange and the lid are spaced from each other.

* * * * *